US008499383B1

(12) United States Patent
Ungaro

(10) Patent No.: US 8,499,383 B1
(45) Date of Patent: Aug. 6, 2013

(54) EXERCISE MAT WITH VISUAL MARKERS FOR ALIGNMENT

(76) Inventor: Alycea Ungaro, New York, NY (US)

( * ) Notice: Subject to any disclaimer, the term of this patent is extended or adjusted under 35 U.S.C. 154(b) by 0 days.

(21) Appl. No.: 13/296,054

(22) Filed: Nov. 14, 2011

Related U.S. Application Data

(60) Provisional application No. 61/413,854, filed on Nov. 15, 2010.

(51) Int. Cl.
*A47G 9/06* (2006.01)
*A63B 26/00* (2006.01)

(52) U.S. Cl.
USPC ..... 5/417; 5/420; 482/23; D6/582

(58) Field of Classification Search
USPC ..... 5/417, 420; 482/23; D6/582
See application file for complete search history.

(56) References Cited

U.S. PATENT DOCUMENTS

| | | | | |
|---|---|---|---|---|
| 3,843,980 | A * | 10/1974 | Rodriguez | 5/733 |
| D457,373 | S * | 5/2002 | Prinzmetal | D6/582 |
| 6,387,013 | B1 * | 5/2002 | Marquez | 482/23 |
| 7,108,635 | B2 * | 9/2006 | Howlett-Campanella | 482/23 |
| 7,465,263 | B1 * | 12/2008 | Conrad et al. | 482/148 |
| D584,093 | S * | 1/2009 | Drumm | D6/582 |
| D599,149 | S * | 9/2009 | White | D6/582 |
| D631,276 | S * | 1/2011 | White | D6/582 |
| 7,955,224 | B2 * | 6/2011 | Curley | 482/23 |
| 8,025,606 | B2 * | 9/2011 | Hamilton | 482/4 |
| 8,096,923 | B2 * | 1/2012 | White | 482/23 |
| D653,894 | S * | 2/2012 | Kieffer | D6/592 |
| 8,220,087 | B2 * | 7/2012 | Villa et al. | 5/420 |
| 8,317,660 | B2 * | 11/2012 | Goranson | 482/23 |
| 2001/0034288 | A1 * | 10/2001 | Howlett-Campanella | 482/23 |
| 2002/0142888 | A1 * | 10/2002 | Marques | 482/23 |
| 2003/0017915 | A1 * | 1/2003 | Prinzmetal | 482/23 |
| 2004/0214692 | A1 * | 10/2004 | Koenig | 482/23 |
| 2007/0088232 | A1 * | 4/2007 | Corradini | 601/28 |
| 2009/0062076 | A1 * | 3/2009 | Curley | 482/23 |
| 2009/0119836 | A1 * | 5/2009 | Sharp | 5/417 |
| 2010/0048356 | A1 * | 2/2010 | Hamilton | 482/4 |
| 2011/0072581 | A1 * | 3/2011 | Villa et al. | 5/420 |
| 2011/0111926 | A1 * | 5/2011 | Goranson | 482/23 |

* cited by examiner

*Primary Examiner* — Robert G Santos
(74) *Attorney, Agent, or Firm* — Knobbe Martens Olson & Bear LLP

(57) ABSTRACT

An exercise mat system and a method of using the same are disclosed. The exercise mat system includes an exercise mat including an upper surface, and a plurality of visual markers positioned on the upper surface of said mat, where the relative positioning of the visual markers correlates to a user's body parts and distances between the user's body parts.

19 Claims, 9 Drawing Sheets

EXERCISE MAT WITH VISUAL MARKERS FOR ALIGNMENT

CROSS-REFERENCE TO RELATED APPLICATION

This application claims the benefit of U.S. Provisional Application No. 61/413,854, filed Nov. 15, 2010 and titled EXERCISE MAT WITH VISUAL MARKERS FOR ALIGNMENT, the disclosure of which is hereby incorporated by reference in its entirety into this application.

BACKGROUND

1. Field

The field relates to exercise mats. In particular, the exercise mat disclosed provides visual markers to help exercisers improve their form and get better results by establishing proper alignment.

2. Description of the Related Art

Pilates is a physical fitness system developed in the early 20th century by Joseph Pilates in Germany. Today there are many millions of practitioners. The program focuses on the core postural muscles which help keep the body balanced and which are essential to providing support for the spine. In particular, pilates exercises teach awareness of breath and alignment of the spine, and aim to strengthen the deep torso muscles. Essentially pilates is an exercise style that involves training the muscles to improve posture and alignment. There are three types of pilates, the most popular being the mat workout, where much time is spent on the floor using gravity and one's own body weight to create resistance.

Yoga is a system of exercises practiced to promote control of the body and mind. While stretching is certainly involved, yoga is really about creating balance in the body through developing both strength and flexibility. This is done through the performance of poses or postures, each of which has specific physical benefits. The poses can be done quickly in succession, creating heat in the body through movement or more slowly to increase stamina and perfect the alignment of the pose. The poses are a constant, but the approach to them varies depending on the tradition in which the teacher has trained.

Conventional exercise mats do not provide indications for placement of body parts to achieve proper form and alignment during exercises like pilates and yoga. Such improper form and misalignment may lessen the benefits of the exercises performed, and may also lead to serious injuries.

A grid of orthogonal lines on a mat is disclosed in U.S. Pat. No. 6,387,013, issued to Marquez. The grid lines disclosed are solid lines not associated with specific body parts, and do not take into account the placement of different body parts depending on the positions taken in the exercise. In addition, the grid lines do not make use of normative data for typical distances between anatomical parts placed on the mats.

SUMMARY OF INVENTIVE EMBODIMENTS

An exercise mat system and a method of using such a system, the exercise mat system including: an exercise mat of a standard width and length, comprising an upper surface, and a plurality of visual markers positioned on the upper surface of said mat, wherein the relative positioning of the visual markers correlates to the proper placement of various body parts while maintaining different poses, and is based on normative data for typical distances between such body parts. In some embodiments, the user is instructed to place body parts on the various visual markers positioned on the mat to perform at least one of a given exercise routine or position.

DETAILED DESCRIPTION OF CERTAIN INVENTIVE EMBODIMENTS

The present disclosure is directed to an exercise mat which includes visual markers. The mat may be used for exercise or recreational activities such as pilates, yoga or any other activity where physical placement of the user's body on the mat may be important for the performance of the exercise and for the avoidance of injuries.

Figure 1:
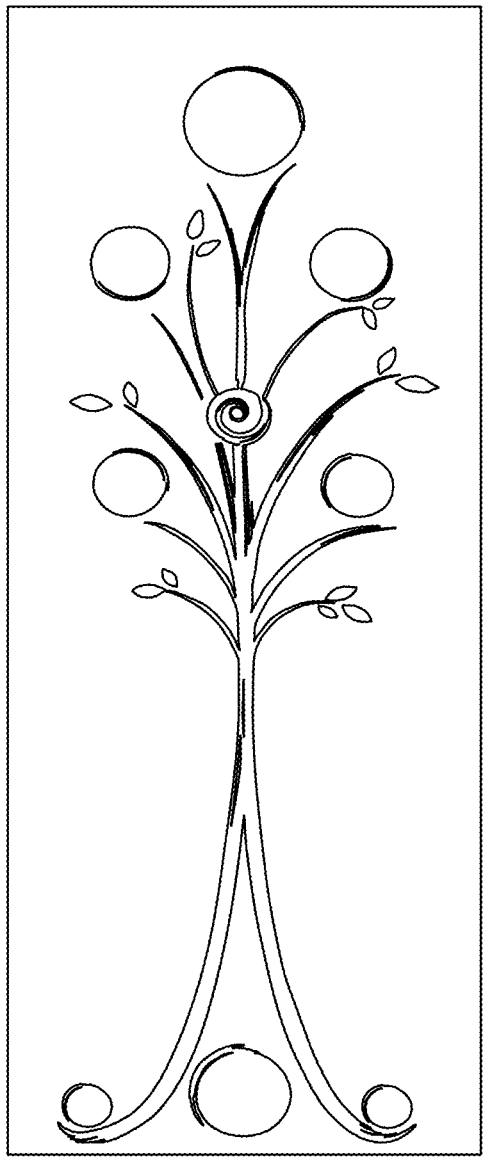
FIG. 1 is a top perspective view of an embodiment of the exercise mat with visual markers.

FIG. 1 is a top perspective view of an embodiment of the exercise mat with visual markers. The exercise mat 10 may be constructed of any well-known material. In one embodiment, the exercise mat 10 is made of rubber-like, soft, water-resistant, resilient and flexible material. In one embodiment, the exercise mat 10 measures about 24 inches wide and about 68.2 inches long. According to the embodiment shown in FIG. 1, the exercise mat 10 includes a set visual markers 15, 20*a* and 20*b*, 25, 30*a* and 30*b*, 35 and 40*a* and 40*b* on its top surface. In one embodiment, the visual markers 15, 20*a* and 20*b*, 25, 30*a* and 30*b*, 35 and 40*a* and 40*b* comprise circles of various sizes. In other embodiments, the visual markers 15, 20*a* and 20*b*, 25, 30*a* and 30*b*, 35 and 40*a* and 40*b* may all be of the same size. In yet other embodiments, other shapes may be used for the visual markers 15, 20*a* and 20*b*, 25, 30*a* and 30*b*, 35 and 40*a* and 40*b*. The markers may be printed or painted on the surface of the mat, or alternatively, may be formed by inlays or appliqués, or by variations in the thickness or surface texture of the mat.

In the embodiment shown in FIG. 1, the visual markers 15, 20*a* and 20*b*, 25, 30*a* and 30*b*, 35 and 40*a* and 40*b* are connected together to create the shape of a tree 50 with the trunk of the tree providing a center line down the middle of the mat. In other embodiments, the visual markers 15, 20*a* and 20*b*, 25, 30*a* and 30*b*, 35 and 40*a* and 40*b* may not be connected to each other, or may be connected to create the shape of another object.

The visual markers may provide indications to a user of the mat of placement of different body parts during different exercises. In one embodiment, visual marker 15 may indicate placement for the head; visual markers 20*a* and 20*b* may indicate placement for the shoulders; visual marker 25 may indicate placement for the navel or abdominals; visual markers 30*a* and 30*b* may indicate placement for the hips; visual marker 35 may indicate placement for the feet when the exercise calls for the user to be lying in a straight line on one's back or front; visual markers 40*a* and 40*b* may indicate alternate placement for the feet when the exercise calls for the user to be lying on one side.

Figure 2:
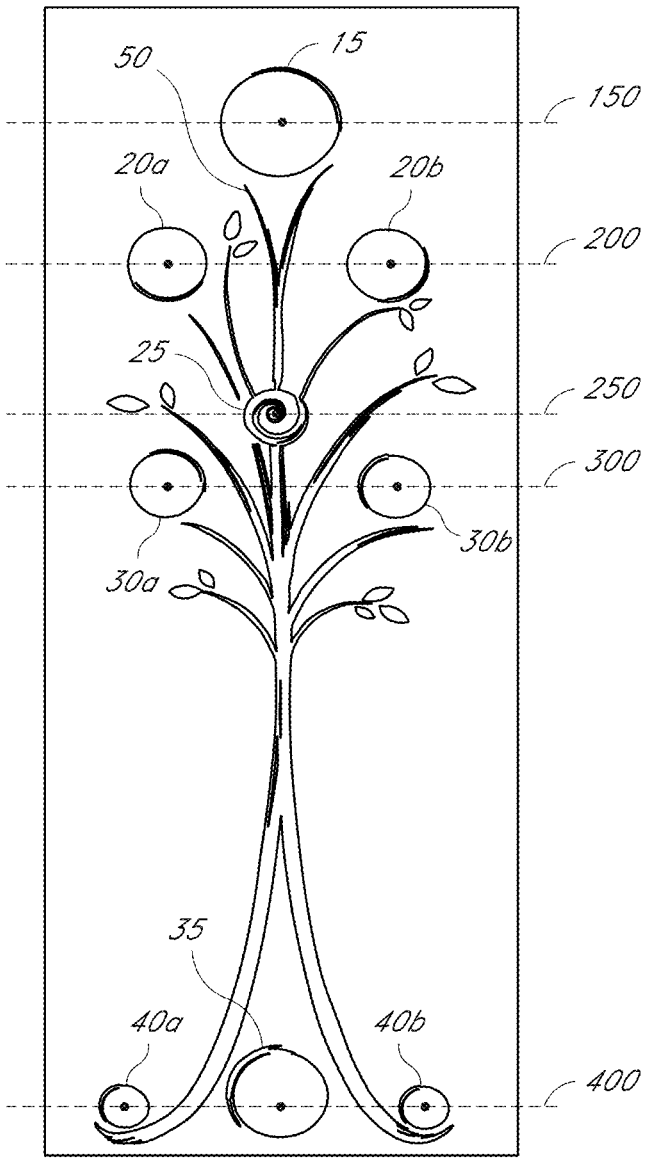
FIG. 2 is a top perspective view of an embodiment of the exercise mat with visual markers and indications of dimensions.

FIG. 2 is a top perspective view of an embodiment of the exercise mat with visual markers and indications of dimensions. As shown in FIG. 2, the visual markers 15, 20*a* and 20*b*, 25, 30*a* and 30*b*, 35 and 40*a* and 40*b* are placed at specific distances from each other. In some embodiments, these distances may be based on normative data correlating to typical distance between users' anatomical parts placed on the exercise mat.

In one embodiment, the vertical distance, when viewing the mat in the orientation as shown in FIG. 1, from the center of visual marker 15 to the centers of visual markers 20*a* and 20*b*, indicated by the distance between lines 150 and 200 may be about 4 inches; the vertical distance, when viewing the mat in the orientation as shown in FIG. 1, from the center of visual markers 20*a* and 20*b* to the center of visual marker 25, indicated by the distance between lines 200 and 250 may be about 15 inches; the vertical distance, when viewing the mat in the orientation as shown in FIG. 1, from the center of visual markers 20*a* and 20*b* to the centers of visual markers 30*a* and 30*b*, indicated by the distance between lines 200 and 300 may be about 19.5 inches; and the vertical distance, when viewing the mat in the orientation as shown in FIG. 1, from the center of visual markers 30*a* and 30*b* to the centers of visual markers 35, 40*a* and 40*b*, indicated by the distance between lines 300 and 400 may be about 40.5 inches. Distances along an orientation parallel to the longitudinal axis of the mat may be considered to be vertical distances, and distances along an orientation perpendicular to, or transverse to, the longitudinal axis of the mat may be considered to be horizontal distances In some embodiments, the ratio of the distance between lines 150 and 200 to the distance between lines 200 and 300 may be between about 0.167 and about 0.204; the ratio of the distance between lines 150 and 200 to the distance between lines 150 and 250 may be between about 0.205 and about 0.215; the ratio of the distance between lines 200 and 300 to the distance between lines 300 and 400 may be between about 0.459 and about 0.562. In one embodiment, the horizontal distance, when viewing the may in the orientation shown in FIG. 1, between the centers of visual markers 20*a* and 20*b* may be about 18 inches; the horizontal distance between the centers of visual markers 30*a* and 30*b* may be about 19.5 inches; the horizontal distance between the centers of visual markers 40*a* and 40*b* may be about 18.5 inches.

When the exercise mat 10 is used for the practice of pilates, for example, the visual markers 15, 20*a* and 20*b*, 25, 30*a* and 30*b*, 35 and 40*a* and 40*b* provide the user with guidance for positioning head, shoulders, hips and feet. By using the markers for positioning, the user achieves proper alignment and symmetry of the body. In one embodiment, the tree 50 provides a center line, or what is known as the plum line, down the middle of the mat to assist with spinal alignment.

FIGS. 3-9 show users of embodiments of the exercise mat performing different exercise positions.

Figure 3:
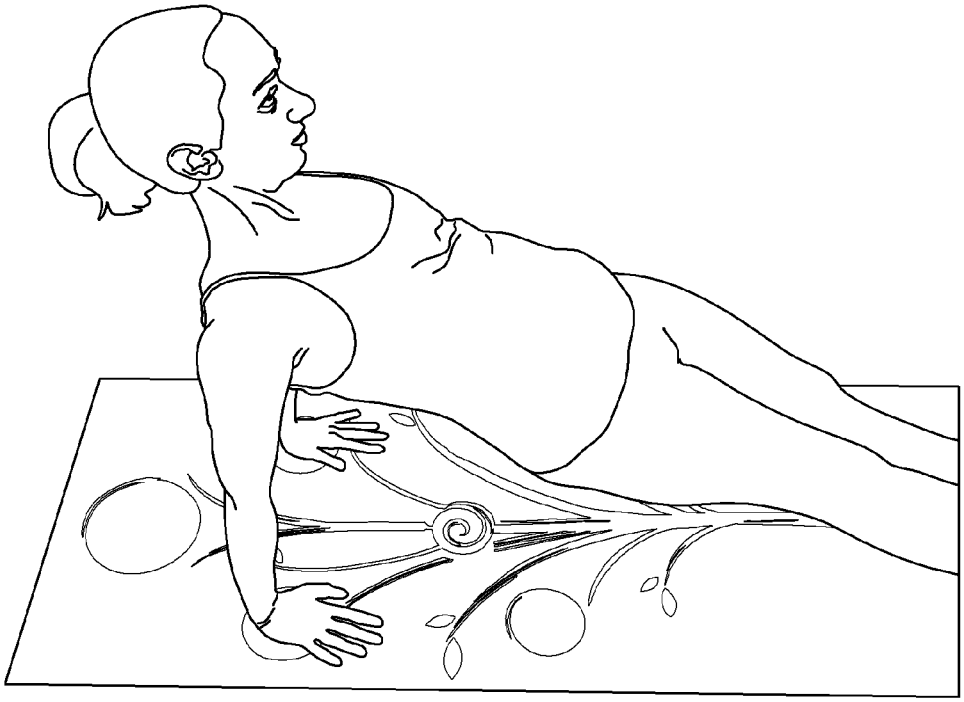
FIGS. 3-4 show users of embodiments of the exercise mat in a reverse plank position.
Figure 4:
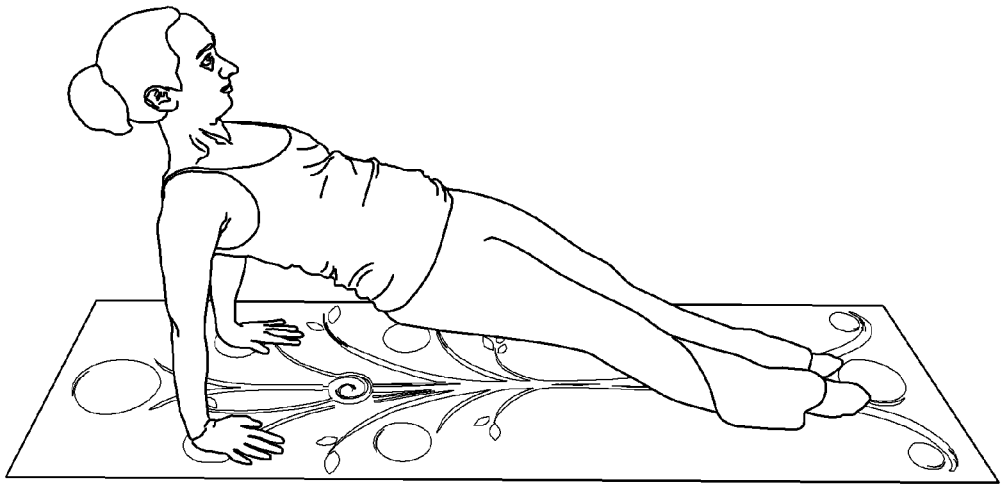

FIGS. 3-4 show users of embodiments of the exercise mat in a reverse plank position. By using the visual markers on the exercise mat as instructed, the user will achieve the proper alignment of the body, and derive the benefits of the exercise. In one embodiment, users may be instructed to sit on the mat with their feet facing the foot circles. The users may then be instructed to place their hands behind them on the shoulder circles. Users may then be instructed to, in one motion, press their hips up and hold their body suspended upwards. The users' legs may be held together down the center line of the "tree" on the mat.

In other embodiments, the exercise mat may be used to perform a full plank position. The plank is an isometric exercise used for strengthening stomach muscles. This position is started by balancing the elbows and toes, while keeping the body in a straight line. The exercise mat can help the user achieve the proper posture. The user may be instructed to align his/her head above visual marker 15, to place his/her elbows on the visual markers 20*a* and 20*b*, align his/her navel above visual marker 25 and to place his/her feet together on visual marker 35. By using the visual markers on the exercise mat as instructed, the user will achieve the proper alignment of the body, and derive the benefits of the exercise. In one embodiment, users may be asked to place their hands directly under their shoulders and atop circles 20*a* and 20*b*, in a push up position. Users may use the center line of the mat to keep them well aligned and place their feet together down the center either in the middle of the mat or on the center circle if they are taller.

Figure 5:
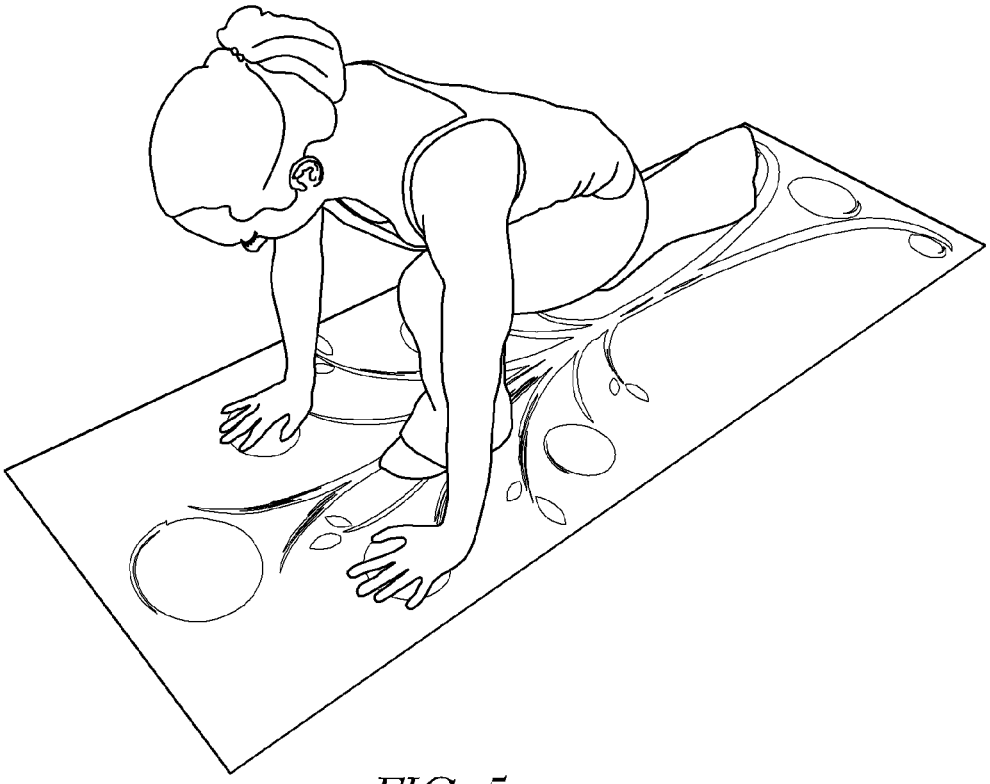
FIGS. 5-6 show a users of embodiments of the exercise mat in a lunge stretch position.
Figure 6:
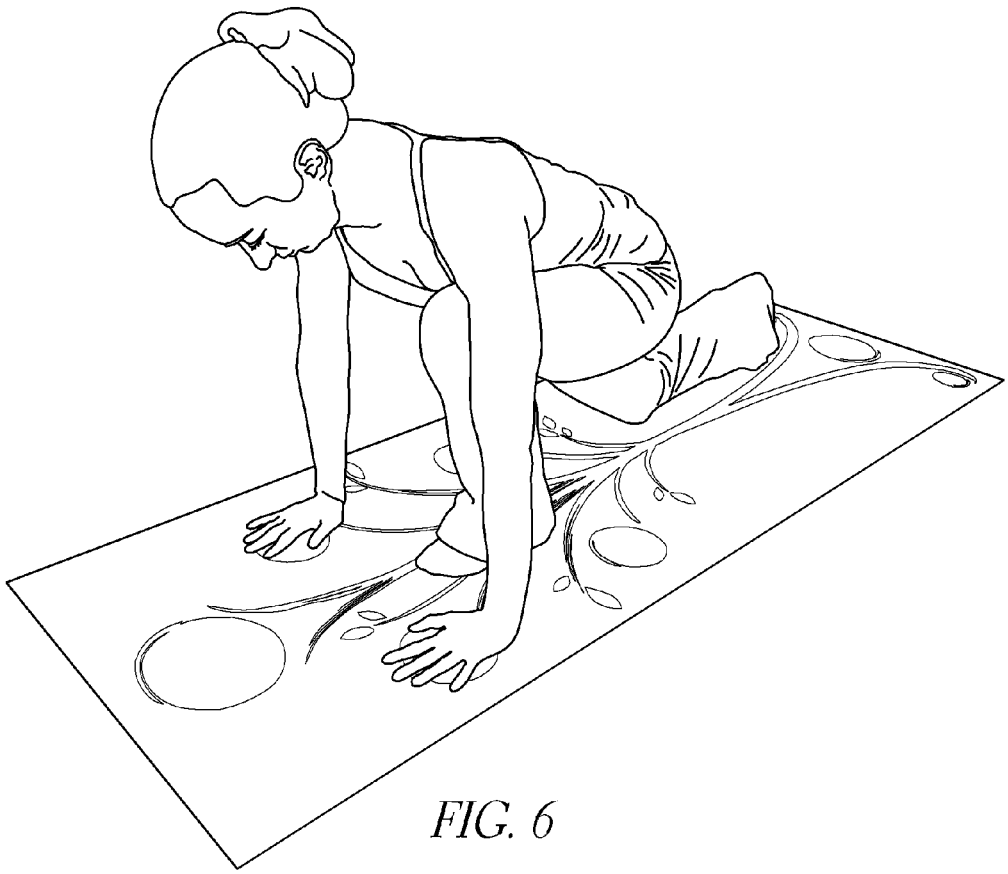

FIGS. 5-6 show users of embodiments of the exercise mat in a lunge stretch position. In some embodiments, users may be instructed to squat down in the center of the mat and place their hands on the shoulder circles. Users may then be instructed to take one leg back alongside the center line and aim their foot for the side foot circle. Users may also be instructed to press their hips forward stretching their thigh and hip muscles progressively deeper. Users may then be instructed to switch sides.

In other embodiments, the exercise mat may be used by users performing a spine stretch forward position. Users may be instructed to sit tall on the mat with their legs wide and one foot on each side foot circle. Users may then be instructed to reach their arms straight up and then round over their legs lining themselves up with the center line of the mat. Users may then be instructed to sit back up tall and straight.

Figure 7:
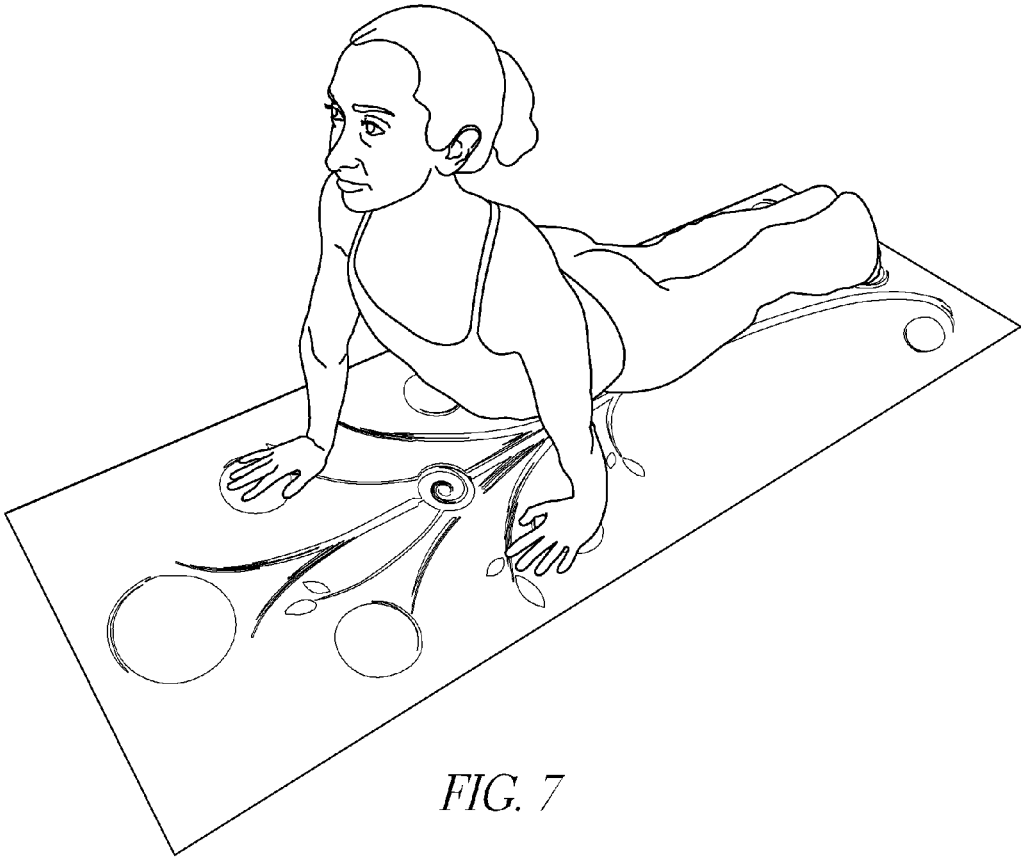
FIGS. 7-9 show users of embodiments of the exercise mat in a pilates snake position.
Figure 8:
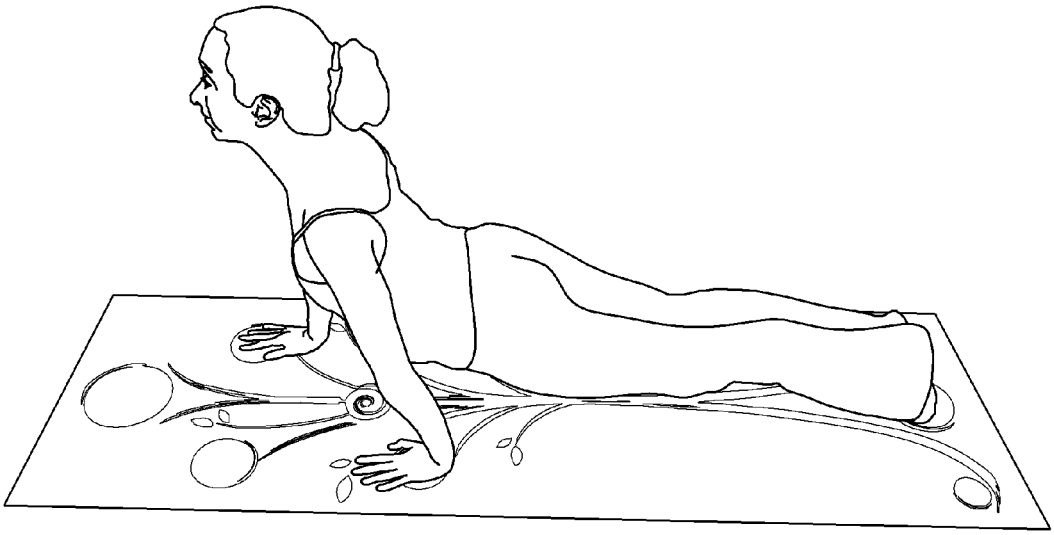
Figure 9:
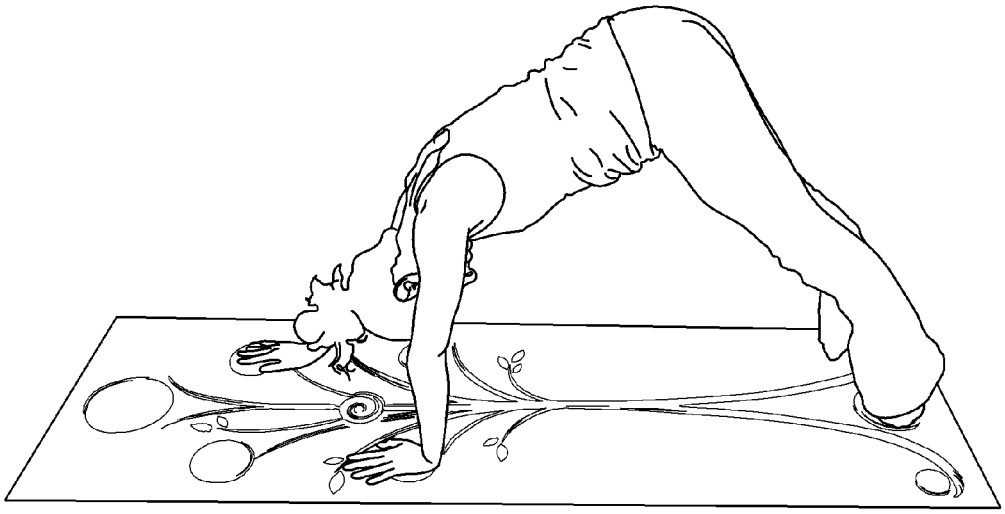

In other embodiments, the exercise mat may be used by users performing side kicks. Users may be instructed to lie on one side at the back edge of their mat. Users may then be instructed to line themselves up so their shoulders and head are in line with the shoulder and head circles. Users may then be asked to angle their legs toward the small foot circle farthest in front of them and place their head on their hand. Users may then be instructed to use their free hand to support themselves by placing their hand either on the navel circle or on the shoulder circle closest to them—whichever feels best. The users would then be ready to start the side kicks FIGS. 7-9 show users of embodiments of the exercise mat in a pilates snake position. Users may be asked to sit on their right hip and stack their legs one atop the other. Users may be instructed that both feet be over the center foot circle. Users may then be instructed to place their right hand on the right shoulder circle and the left hand on the left hip circle. Users may then be asked to lift up in a pike sending their hips up to the sky, dropping their head and rising on to their toes.

While the above detailed description has shown, described, and pointed out novel features as applied to various embodiments, it will be understood that various omissions, substitutions, and changes in the form and details of the exercise mat or exercises illustrated may be made without departing from the spirit of the disclosure. As will be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. An exercise mat system, comprising:

an exercise mat comprising an upper surface; and a plurality of visual markers positioned on the upper surface of said mat, wherein the relative positioning of the visual markers correlates to a user's body parts and distances between the user's body parts, wherein the visual markers are positioned asymmetrically with respect to a transverse axis across a center of the mat, wherein the plurality of visual markers are connected to one another through a center line across a vertical axis of the mat and wherein the center line is configured to assist with spinal alignment.

2. The exercise mat system of claim 1, the mat having a generally rectangular shape.

3. The exercise mat system of claim 1, wherein each of the plurality of visual markers comprises a circle.

4. The exercise mat system of claim 1, wherein the plurality of visual markers are of the same size.

5. The exercise mat system of claim 1, wherein the plurality of visual markers are of different sizes.

6. The exercise mat system of claim 1, wherein the plurality of visual markers are connected to one another in the shape of a tree.

7. The exercise mat system of claim 1, wherein the user's body parts may be the user's head, shoulder, hip, navel and foot.

8. The exercise mat system of claim 7, wherein the distances between the user's body parts are substantially correlated to anatomical norms for such distances.

9. The exercise mat system of claim 8, wherein a vertical distance between the visual marker for the head and the visual markers for the shoulders is about 4 inches.

10. The exercise mat system of claim 8, wherein a vertical distance between the visual markers for the shoulders and the visual markers for the hips is about 20 inches.

11. The exercise mat system of claim 8, wherein a vertical distance between the visual markers for the shoulders and the visual marker for the navel is about 15 inches.

12. The exercise mat system of claim 8, wherein a vertical distance between the visual markers for the hips and the visual markers for the feet is about 40.5 inches.

13. The exercise mat system of claim 8, wherein a horizontal distance between the visual markers for the shoulders is about 18 inches.

14. The exercise mat system of claim 8, wherein a horizontal distance between the visual markers for the hips is about 19.5 inches.

15. The exercise mat system of claim 8, wherein a horizontal distance between the visual markers for the feet is about 18.5 inches.

16. The exercise mat system of claim 8, wherein a ratio of a vertical distance between the visual markers for the head and shoulders to a vertical distance between the visual markers for the shoulders and hips is between about 0.167 and about 0.204.

17. The exercise mat system of claim 8, wherein a ratio of a vertical distance between the visual markers for the head and shoulders to a vertical distance between the visual markers for the head and navel is between about 0.205 and about 0.215.

18. The exercise mat system of claim 8, wherein a ratio of a vertical distance between the visual markers for the shoulders and hips to a vertical distance between the visual markers for the hips and feet is between about 0.459 and about 0.562.

19. A method of using an exercise mat system comprising an upper surface and a plurality of visual markers positioned on the upper surface of said mat, wherein the relative positioning of the visual markers correlates to a user's body parts and distances between the user's body parts, wherein the visual markers are positioned asymmetrically with respect to a transverse axis across a center of the mat, wherein the plurality of visual markers are connected to one another in the shape of a tree, with the trunk of the tree providing a center line across a vertical axis of the mat to assist with spinal alignment and wherein the user is instructed to place body parts on the various visual markers positioned on the mat to perform at least one of a given exercise routine or position.

* * * * *